US012778244B1

(12) United States Patent
Chen et al.

(10) Patent No.: US 12,778,244 B1
(45) Date of Patent: Nov. 3, 2026

(54) MAGNETIC TYPE QUICK DISASSEMBLY BUCKLE

(71) Applicant: Zhongshan Yuanyu Precision Metal Products Co., Ltd., Zhongshan City (CN)

(72) Inventors: Weiming Chen, Zhongshan City (CN); Hui Zhou, Zhongshan City (CN)

(73) Assignee: Zhongshan Yuanyu Precision Metal Products Co., Ltd., Zhongshan City (CN)

( * ) Notice: Subject to any disclaimer, the term of this patent is extended or adjusted under 35 U.S.C. 154(b) by 0 days.

(21) Appl. No.: 19/215,452

(22) Filed: May 22, 2025

(30) Foreign Application Priority Data

Apr. 16, 2025 (CN) ..... 202510477158.6

(51) Int. Cl.
*A44B 11/25* (2006.01)

(52) U.S. Cl.
CPC ..... *A44B 11/2511* (2013.01)

(58) Field of Classification Search
CPC ..... A44B 11/2511
See application file for complete search history.

(56) References Cited

U.S. PATENT DOCUMENTS 5,150,504 A * 9/1992 Cohen ..... A45F 5/02 24/3.13
5,699,594 A * 12/1997 Czank ..... A44B 11/2511 24/632
5,709,014 A * 1/1998 Takahashi ..... A44B 11/2511 24/615
5,784,767 A * 7/1998 Doty, Jr. ..... A44B 11/2511 24/665
6,516,982 B1 * 2/2003 Childers ..... A63B 47/001 224/919
6,857,169 B2 * 2/2005 Chung ..... A44B 11/258 24/303
10,085,521 B2 * 10/2018 Chen ..... A45C 13/1069
10,143,270 B2 * 12/2018 Fiedler ..... A44B 11/2588
10,212,993 B2 * 2/2019 Fiedler ..... A44B 11/2588
11,160,330 B1 * 11/2021 Tseng ..... A44B 11/25
11,533,970 B1 * 12/2022 Tseng ..... A44B 11/2592
11,892,756 B2 * 2/2024 Ruckman ..... A44B 11/2584
D1,040,690 S * 9/2024 Cheng ..... A44B 11/2511 D11/220
2015/0113772 A1 * 4/2015 Dering ..... A45F 5/00 24/591.1
2019/0174875 A1 * 6/2019 Cheng ..... A44B 11/258
2019/0380453 A1 * 12/2019 Hortnagl ..... A44B 11/2584
(Continued)

*Primary Examiner* — Jason W San
(74) *Attorney, Agent, or Firm* — Bay State IP, LLC

(57) ABSTRACT

A magnetic type quick disassembly buckle includes a buckle seat and a quick assembly plate. A sliding chute matched with the quick assembly plate is formed in the top of the buckle seat. A limit slot is formed in the bottom of the sliding chute. The limit slot is internally provided with an iron bar. The quick assembly plate is internally provided with a magnetic block. A clamping slot is formed in the bottom of the quick assembly plate. A button communicating with the clamping slot is disposed on the top of the quick assembly plate. During clamping, the quick assembly plate may be transversely inserted into the sliding chute. The iron bar is clamped into the clamping slot through suction of the magnetic block so as to lock the buckle seat and the quick assembly plate.

9 Claims, 3 Drawing Sheets

(56) References Cited

U.S. PATENT DOCUMENTS

| | | | | |
|---|---|---|---|---|
| 2024/0032656 | A1* | 2/2024 | Coursimault | A44B 11/065 |
| 2024/0180300 | A1* | 6/2024 | Si | A44B 11/25 |
| 2025/0049179 | A1* | 2/2025 | Zhuang | A44B 11/2511 |

* cited by examiner

MAGNETIC TYPE QUICK DISASSEMBLY BUCKLE

CROSS REFERENCE TO RELATED APPLICATION

This application claims priority to and takes the benefit of Chinese Patent Application No. 202510477158.6 filed on Apr. 16, 2025, the contents of which are herein incorporated by reference.

TECHNICAL FIELD

The present disclosure belongs to the technical field of connection buckles, and in particular, to a magnetic type quick disassembly buckle.

BACKGROUND

The quick disassembly buckle, which is a device that can quickly connect and disassemble two parts, has the advantages of simple and fast operation and can realize connection and separation of parts in a short time. The quick disassembly buckle is widely used in the fields of cameras, backpacks and the like. An existing quick disassembly buckle adopts a mechanical locking mechanism to realize locking between a quick assembly plate and a main part. A stopper designed at the bottom of a sliding chute of a part of quick disassembly buckles is too large, so even if the quick assembly plate is not fully engaged, a lock tongue will still trigger a "click" sound, which is easy for users to misjudge that the quick assembly plate has been installed in place. Then, it is difficult for a user to intuitively judge an installation state of the quick disassembly buckle, and it is necessary to shake the quick disassembly buckle from side to side for the second time to confirm whether the installation is in place, thereby increasing complexity of operation. Great effort is required when a triangular loop of a part of quick disassembly buckles is disassembled, and there is a risk of accidental nail injury.

Therefore, a magnetic type quick disassembly buckle which is firm in structure without dropping out by mistake and convenient and labor-saving in disassembly needs to appear urgently.

SUMMARY

The present disclosure provides a magnetic type quick disassembly buckle so as to solve the technical problem that an ordinary quick disassembly buckle is insufficient in firmness, not prone to install in place and laborious in disassembly in the prior art.

The present disclosure is realized through the following technical solutions. A magnetic type quick disassembly buckle includes a buckle seat and a quick assembly plate. A sliding chute matched with the quick assembly plate is form. A limit slot is formed in the bottom of the sliding chute. The limit slot is internally provided with an iron bar. The quick assembly plate is internally provided with a magnetic block. A clamping slot is formed in the bottom of the quick assembly plate. A button communicating with the clamping slot is disposed on the top of the quick assembly plate. During clamping, the quick assembly plate may be transversely inserted into the sliding chute. The iron bar is clamped into the clamping slot through suction of the magnetic block so as to lock the buckle seat and the quick assembly plate.

In order to realize the present disclosure preferably, further optimization is made in the above structure, the buckle seat is provided with a first side plate and a second side plate. The first side plate and the second side plate are symmetrically disposed. The first side plate, the second side plate and a top surface of the buckle seat are encircled to form the sliding chute. A first slot and a second slot are formed in opposite inner walls of the first side plate and the second side plate respectively. One end of the limit slot communicates with the first slot, and the other end of the limit slot communicates with the second slot and runs through the second side plate. Both ends of the iron bar stretch into the first slot and the second slot respectively.

In order to realize the present disclosure preferably, further optimization is made in the above structure, the magnetic type quick disassembly buckle further includes a plug, where the plug is detachably disposed inside the second slot.

In order to realize the present disclosure preferably, further optimization is made in the above structure, one end of the sliding chute is a narrow opening, and the other end of the sliding chute is a wide opening. The quick assembly plate is a trapezoidal plate matched with a cross-sectional shape of the sliding chute.

In order to realize the present disclosure preferably, further optimization is made in the above structure, tops of opposite inner walls of the first side plate and the second side plate are provided with a first upper baffle plate and a second upper baffle plate respectively. Ends, close to the narrow opening of the sliding chute, of the first side plate and the second side plate are provided with a first limit plate and a second limit plate respectively.

In order to realize the present disclosure preferably, further optimization is made in the above structure, a connecting hole is formed in one end, away from narrow opening of the sliding chute, of the buckle seat. A connecting rope is disposed at one end, close to the narrow opening of the sliding chute, of the quick assembly plate.

In order to realize the present disclosure preferably, further optimization is made in the above structure, a through hole communicating with the slot is formed in the quick assembly plate, and the button is movably connected into the through hole.

In order to realize the present disclosure preferably, further optimization is made in the above structure, both ends of the button are provided with an upper baffle disc and a lower baffle disc respectively. An upper sink slot and a lower sink slot are formed in both ends of the through hole respectively. During clamping, the button moves upward so that the lower baffle disc abuts against inside of the lower sink disc. During buckle release, the upper baffle disc moves downward so that the upper baffle disc abuts against inside of the upper sink slot.

In order to realize the present disclosure preferably, further optimization is made in the above structure, the buckle seat and the quick assembly plate are both rigid plastic structural members.

Compared with the prior art, the present disclosure has the following beneficial effects.

The magnetic type quick disassembly buckle provided by the present disclosure includes a buckle seat and a quick assembly plate. A sliding chute matched with the quick assembly plate is formed in the top of the buckle seat. A limit slot is formed in the bottom of the sliding chute. The limit slot is internally provided with an iron bar. The quick assembly plate is internally provided with a magnetic block. A clamping slot is formed in the bottom of the quick assembly plate. A button communicating with the clamping slot is disposed on the top of the quick assembly plate. During clamping, the quick assembly plate may be transversely inserted into the sliding chute. The iron bar is clamped into the clamping slot through suction of the magnetic block so as to lock the buckle seat and the quick assembly plate. By using the structure, the quick assembly plate is inserted into the sliding chute of the buckle seat when in use, and a magnetic force of the magnetic block enables the iron bar in the limit slot to move upward and be clamped in the clamping slot of the quick assembly plate, so that the quick assembly plate and the buckle seat are firmly locked. When clamping is released, the iron bar is reset by pressing the button, and then the quick assembly plate is translated in an opposite direction. The magnetic type quick disassembly buckle is simple in structure, firm in structure without dropping out by mistake, convenient and labor-saving in buckle release, and wide in application prospects.

BRIEF DESCRIPTION OF THE DRAWINGS

To describe the technical solutions in the embodiments of the present disclosure or in the prior art more clearly, the following briefly describes the attached figures required for describing the embodiments or the prior art. Apparently, the attached figures in the following description show merely some embodiments of the present disclosure, and a person of ordinary skill in the art may derive other drawings from these attached figures without creative efforts.

REFERENCE SIGNS

Figure 1:
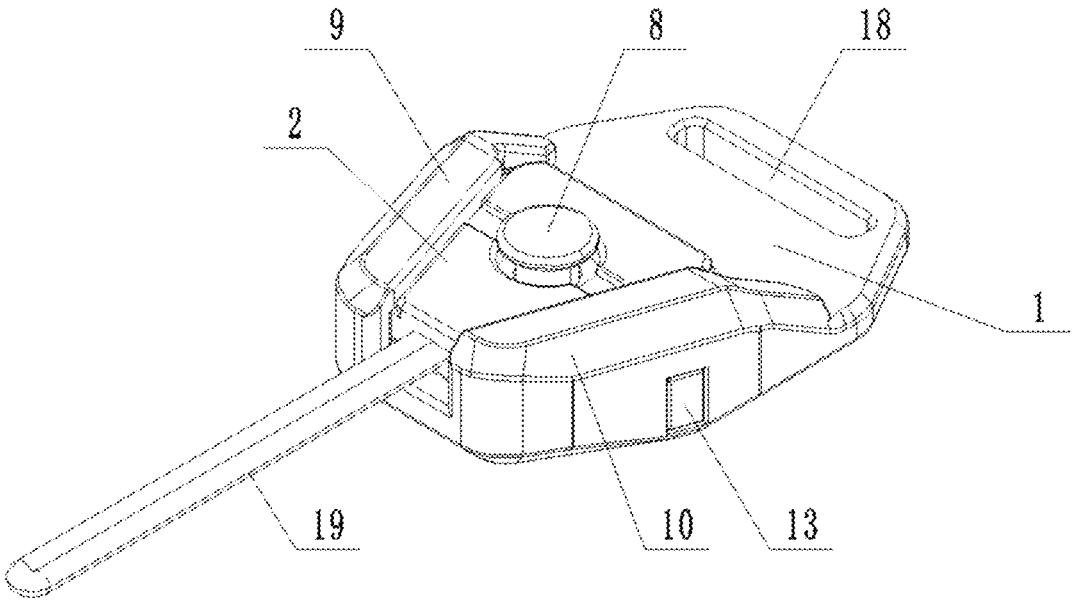
FIG. 1 is a space diagram of a magnetic type quick disassembly buckle in the present disclosure.
Figure 2:
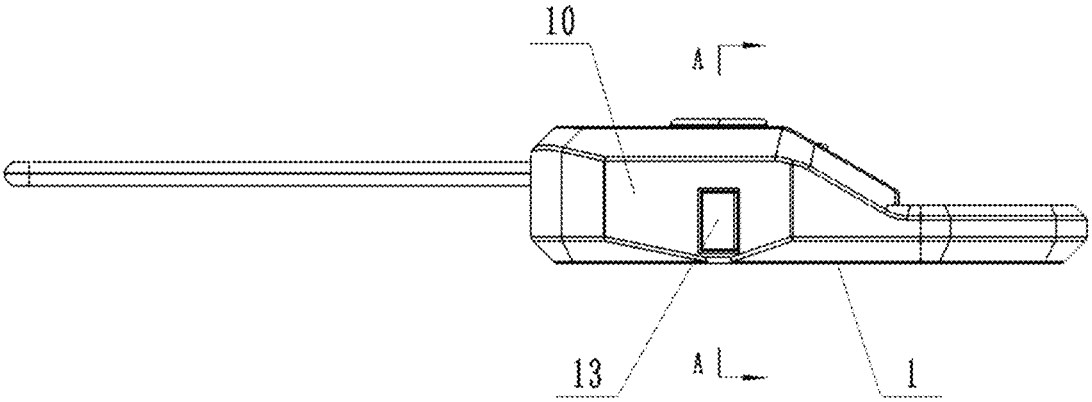
FIG. 2 is a front view of a magnetic type quick disassembly buckle in the present disclosure.

1: buckle seat; 2: quick assembly plate; 3: sliding chute; 4: limit slot; 5: iron bar; 6: magnetic block; 7: clamping slot; 8: button; 9: first side plate; 10: second side plate; 11: first slot; 12: second slot; 13: plug; 14: first upper baffle plate; 15: second upper baffle plate; 16: first limit plate; 17: second limit plate; 18: connecting hole; 19: connecting rope; 20: upper baffle disc; 21: lower baffle disc; 22: upper sink slot; 23: lower sink slot; and 24: through hole.

DETAILED DESCRIPTION OF THE EMBODIMENTS

In order to make the purpose, technical scheme and advantages of the present disclosure more clear, the technical scheme of the present disclosure is described in detail as follows. Apparently, the embodiments in the following description are merely a part rather than all of the embodiments of the present disclosure. Based on the embodiment in the present disclosure, all other embodiments obtained by the ordinary technical staff in the art under the premise of without contributing creative labor belong to the scope protected by the present disclosure.

In the description of the present disclosure, it needs to be illustrated that, except as otherwise noted, the meaning of "a plurality of" is two or more than two; and the indicative direction or position relations of the terms such as "upper", "lower", "left", "right", "inside", "outside", "front end", "rear end", "head" and "tail" are direction or position relations illustrated based on the accompanying diagrams, just for facilitating the description of the present disclosure and simplifying the description, but not for indicating or hinting that the indicated device or element must be in a specific direction and is constructed and operated in the specific direction, the terms cannot be understood as the restriction of the present disclosure. Moreover, the terms such as "first", "second", and "third" are just used for distinguishing the description, but cannot be understood to indicate or hint relative importance.

In the description of the present disclosure, it further needs to be illustrated that, except as otherwise noted, the terms such as "install", "link" and "connect" should be generally understood. For example, the components can be fixedly connected, and also can be detachably connected or integrally connected; the components can be mechanically connected, and also can be electrically connected; and the components can be directly connected, and also can be indirectly connected through an intermediate. For those skilled in the art, the specific meanings of the terms in the present disclosure can be understood according to specific conditions.

Embodiment I

In the embodiment, a magnetic type quick disassembly buckle, as shown in FIG. 1 to FIG. 5, includes a buckle seat 1 and a quick assembly plate 2. Specifically, a sliding chute 3 matched with the quick assembly plate 2 is formed in the top of the buckle seat 1. The sliding chute 3 is transversely disposed along a horizontal direction. The quick assembly plate 2 may be inserted into the sliding chute 3 from one end of the sliding chute 3. A limit slot 4 is formed in the bottom of the sliding chute 3. The limit slot 4 is internally provided with an iron bar 5. The iron bar 5 sinks in the limit slot 4. The quick assembly plate 2 is internally provided with a magnetic block 6. A clamping slot 7 is formed in the bottom of the quick assembly plate 2. The magnetic block 6 is configured to attract the iron bar 5, so that the iron bar 5 may move upward under the action of a magnetic attraction force, and a part of the iron bar 5 is clamped in the clamping slot 7. A button 8 communicating with the clamping slot 7 is disposed on the top of the quick assembly plate 2. The button 8 is configured to press the iron bar 5 during buckle release, so that the iron bar 5 is returned into the limit slot 4. During clamping, the quick assembly plate 2 is transversely inserted into the sliding chute 3. The iron bar 5 is clamped into the clamping slot 7 through suction of the magnetic block 6 so as to lock the buckle seat and the quick assembly plate 2.

By adopting this structure, when in use, the quick assembly plate 2 is inserted into the sliding chute 3 of the buckle seat 1, and the magnetic force of the magnetic block 6 causes the iron bar 5 in the limit slot 4 to move upward and be clamped in the clamping slot 7 of the quick assembly plate 2, so that the quick assembly plate 2 and the buckle seat 1 are firmly locked. During buckle release, the iron bar 5 is reset by pressing the button 8 only. And then the quick assembly plate 2 is translated in an opposite direction. The magnetic type quick disassembly buckle is simple in structure, firm in structure without dropping out by mistake, convenient and labor-saving in buckle release, and wide in application prospects.

Figure 3:
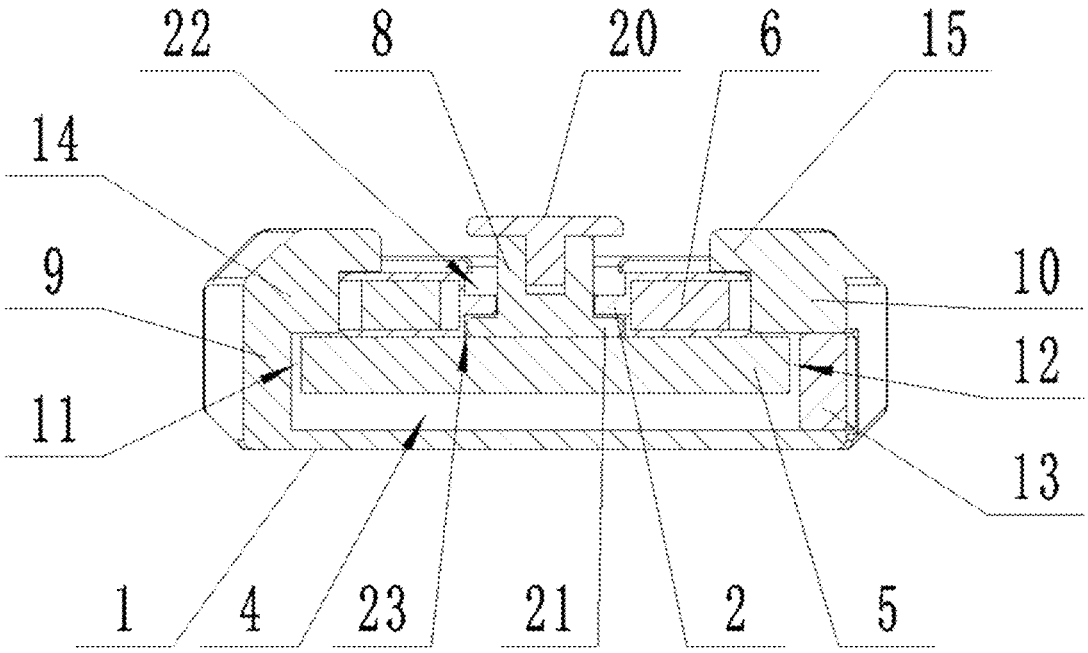
FIG. 3 is a view of A-A in FIG. 2.
Figure 4:
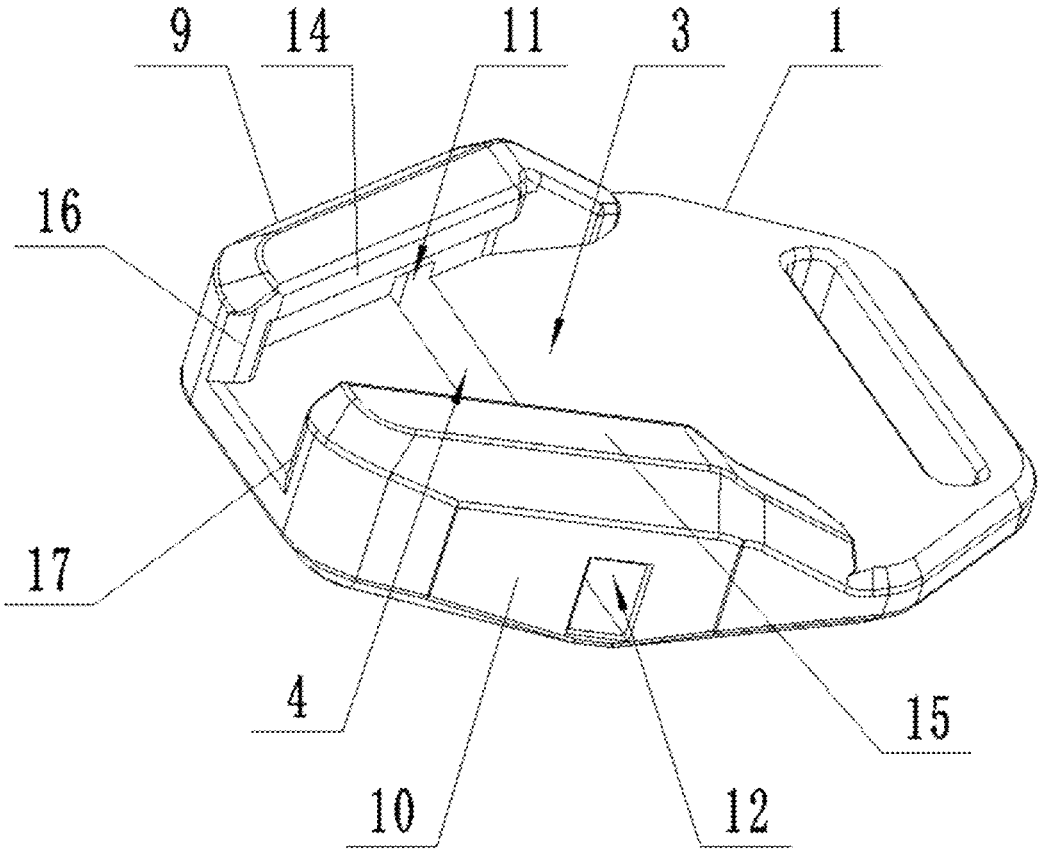
FIG. 4 is a schematic structural diagram of a buckle seat.

As a specific example of this embodiment, as shown in FIG. 1, FIG. 3 and FIG. 4, the buckle seat 1 is provided with a first side plate 9 and a second side plate 10. The first side plate 9 and the second side plate 10 are symmetrically disposed. The first side plate 9 and the second side plate 10 are parallel to each other, and also may be inclined to each other. The first side plate 9, the second side plate 10 and a top surface of the buckle seat 1 are encircled to form the sliding chute 3. A first slot 11 and a second slot 12 are formed in opposite inner walls of the first side plate 9 and the second side plate 10 respectively. One end of the limit slot 4 communicates with the first slot 11, and the other end of the limit slot 4 communicates with the second slot 12 and runs through the second side plate 10. Both ends of the iron bar 5 stretch into the first slot 11 and the second slot 12 respectively. Top positions of the first slot 11 and the second slot 12 are higher than the limit slot 4. When the iron bar 5 is attracted by the magnetic block 6, the iron bar 5 moves upward. At this time, both ends of the iron bar 5 also move upward to tops of the first slot 11 and the second slot 12, and then are limited by top walls of the first slot 11 and the second slot 12, so that the iron bar 5 is locked transversely and longitudinally, and the quick assembly plate 2 and the buckle seat 1 are firmly locked.

It is worth noting that, as shown in FIG. 3, when the quick assembly plate 2 is completely inserted into the buckle seat 1, the clamping slot 7 at the bottom of the quick assembly plate 2 is just aligned with the limit slot 4 on the buckle seat 1, and the iron bar 5 is attracted by the magnetic block 6 to move upward and be clamped into the clamping slot 7. At this time, the iron bar 5 will lift the button 8 together, and a user can intuitively see that the button 8 is pushed up, so as to confirm that locking of the quick assembly plate 2 and the buckle seat 1 is completed without secondary confirmation of in-place installation.

In this embodiment, as described in FIG. 3, the number of the magnetic blocks 6 is two. Insert holes are formed in both sides of the quick assembly plate 2. The magnetic blocks 6 are inserted into the insert holes. The insert holes are located at both ends above the clamping slot 7. When the buckle seat 1 and the quick assembly plate 2 are clamped in place, the magnetic blocks 6 are located just above the iron bar 5, so that the iron bar 5 can be quickly attracted to move upward and be clamped into the clamping slot 7.

In this embodiment, the magnetic type quick disassembly buckle further includes a plug 13. The plug 13 is detachably disposed inside the second slot 12. During installation, first the iron bar 5 runs through one end of the second side plate 10 through the limit slot 4 to be placed into the limit slot 4, and then the plug 13 is used to block the iron bar 5 to prevent the iron bar 5 from falling out of the limit slot 4.

Figure 5:
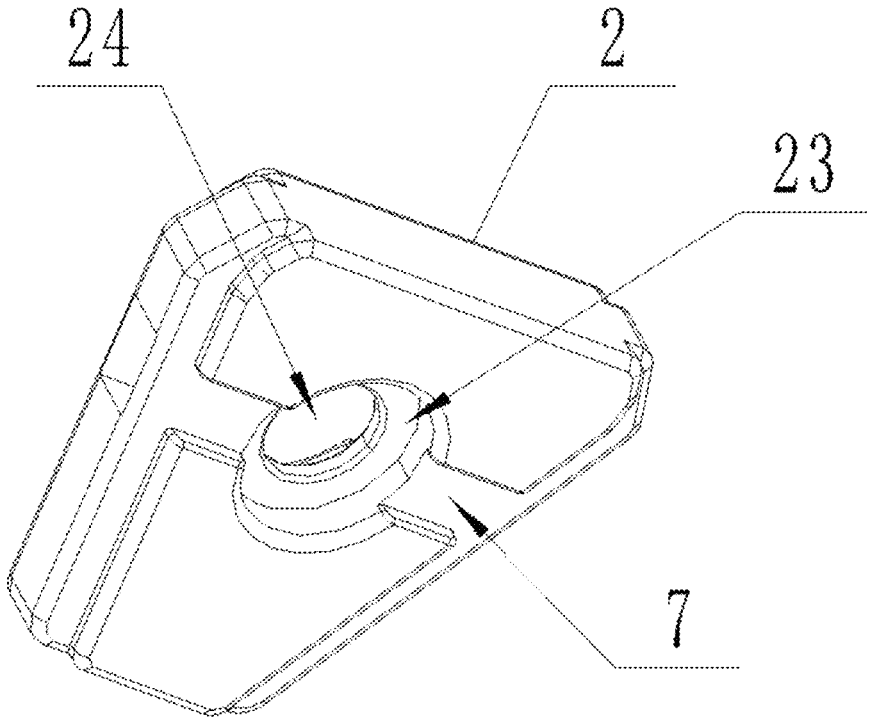
FIG. 5 is a schematic structural diagram of a quick assembly plate.

In this embodiment, as shown in FIG. 4 and FIG. 5, one end of the sliding chute 3 is a narrow opening, and the other end of the sliding chute 3 is a wide opening. The quick assembly plate 2 is a trapezoidal plate matched with a cross-sectional shape of the sliding chute 3, so that an edge of the quick assembly plate 2 can be completely laminated with a slot wall of the sliding chute 3. At this time, the quick assembly plate 2 reaches a final position of inserting the sliding chute 3, that is, installation is in place. At this time, the limit slot 4 and the clamping slot 7 are aligned up and down, and the iron bar 5 can move upward and be clamped into the clamping slot 7 under the action of magnetic force.

Further, as shown in FIG. 4, in order to strengthen position constraint of the quick assembly plate 2, tops of opposite inner walls of the first side plate 9 and the second side plate 10 are provided with a first upper baffle plate 14 and a second upper baffle plate 15 respectively. Ends, close to the narrow opening of the sliding chute 3, of the first side plate 9 and the second side plate 10 are provided with a first limit plate 16 and a second limit plate 17 respectively. The first upper baffle plate 14 and the second upper baffle plate 15 limit the quick assembly plate 2 vertically, so that the quick assembly plate 2 is free of a degree of freedom vertically, and cannot move up and down. The first limit plate 16 and the second limit plate 17 limit the quick assembly plate 2 at one end transversely to cooperate with clamping limit of the iron bar 5 and the clamping slot 7, so that the quick assembly plate 2 is free of degree of freedom transversely and cannot move left and right. Therefore, the quick assembly plate 2 and the buckle seat 1 are firmly locked.

In this embodiment, as shown in FIG. 1, a connecting hole 18 is formed in one end, away from narrow opening of the sliding chute 3, of the buckle seat 1, and a connecting rope 19 is disposed at one end, close to the narrow opening of the sliding chute 3, of the quick assembly plate 2. The connecting hole 18 and the connecting rope 19 are connected to two objects respectively, so that the two objects can be firmly connected through quick-release cooperation of the buckle seat 1 and the quick assembly plate 2.

According to one preferred embodiment, as shown in FIG. 5, a through hole 24 communicating with the slot 7 is formed in the quick assembly plate 2, and the button 8 is movably connected into the through hole 24. When the buckle seat 1 and the quick assembly plate 2 are clamped, the iron bar 5 jacks up the button 8, so that the button 8 moves upward along the through hole 24 and protrudes out of a top surface of the quick assembly plate 2.

Preferably, as shown in FIG. 3, both ends of the button 8 are provided with an upper baffle disc 20 and a lower baffle disc 21 respectively. An upper sink slot 22 and a lower sink slot 23 are formed in both ends of the through hole 24 respectively. During clamping, the button 8 moves upward so that the lower baffle disc 21 abuts against inside of the lower sink disc 23. During buckle release, the upper baffle disc 20 moves downward so that the upper baffle disc 20 abuts against inside of the upper sink slot 22. The upper baffle disc 20 and the lower baffle disc 21 play a role in falling prevention to prevent the button 8 from being separated from the quick assembly plate 2. The lower baffle disc 21 and the button 8 are integrally formed. The upper baffle disc 20 may be in threaded connection to the button 8.

In this embodiment, the buckle seat 1 and the quick assembly plate 2 are both rigid plastic structural members. When the buckle seat 1 and the quick assembly plate 2 are clamped, the iron bar 5 hits the quick assembly plate 2 under the action of the magnetic block 6, thereby producing a crisp knocking sound and facilitating to immediately know that the installation has been in place for the user to complete locking. The magnetic type quick disassembly buckle is high in structural strength and long in service life.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present invention shall be subject to the protection scope of the claims.

What is claimed is:

1. A magnetic type quick disassembly buckle, comprising a buckle seat (1) and a quick assembly plate (2), wherein a sliding chute (3) matched with the quick assembly plate (2) is formed in the top of the buckle seat (1), a limit slot (4) is formed in the bottom of the sliding chute (3), the limit slot (4) is internally provided with an iron bar (5), the quick assembly plate (2) is internally provided with a magnetic block (6), a clamping slot (7) is formed in the bottom of the quick assembly plate (2), a button (8) communicating with the clamping slot (7) is disposed on the top of the quick assembly plate (2), during clamping, the quick assembly plate (2) may be transversely inserted into the sliding chute (3), the iron bar (5) is clamped into the clamping slot (7) through suction of the magnetic block (6) so as to lock the buckle seat and the quick assembly plate (2).

2. The magnetic type quick disassembly buckle according to claim 1, wherein the buckle seat (1) is provided with a first side plate (9) and a second side plate (10), the first side plate (9) and the second side plate (10) are symmetrically disposed, the first side plate (9), the second side plate (10) and a top surface of the buckle seat (1) are encircled to form the sliding chute (3), a first slot (11) and a second slot (12) are formed in opposite inner walls of the first side plate (9) and the second side plate (10) respectively, one end of the limit slot (4) communicates with the first slot (11), the other end of the limit slot (4) communicates with the second slot (12) and runs through the second side plate (10), and both ends of the iron bar (5) stretch into the first slot (11) and the second slot (12) respectively.

3. The magnetic type quick disassembly buckle according to claim 2, further comprising a plug (13), wherein the plug (13) is detachably disposed inside the second slot (12).

4. The magnetic type quick disassembly buckle according to claim 3, wherein one end of the sliding chute (3) is a narrow opening, the other end of the sliding chute (3) is a wide opening, and the quick assembly plate (2) is a trapezoidal plate matched with a cross-sectional shape of the sliding chute (3).

5. The magnetic type quick disassembly buckle according to claim 4, wherein tops of opposite inner walls of the first side plate (9) and the second side plate (10) are provided with a first upper baffle plate (14) and a second upper baffle plate (15) respectively, and ends, close to the narrow opening of the sliding chute (3), of the first side plate (9) and the second side plate (10) are provided with a first limit plate (16) and a second limit plate (17) respectively.

6. The magnetic type quick disassembly buckle according to claim 5, wherein a connecting hole (18) is formed in one end, away from narrow opening of the sliding chute (3), of the buckle seat (1), and a connecting rope (19) is disposed at one end, close to the narrow opening of the sliding chute (3), of the quick assembly plate (2).

7. The magnetic type quick disassembly buckle according to claim 1, wherein a through hole (24) communicating with the slot (7) is formed in the quick assembly plate (2), and the button (8) is movably connected into the through hole (24).

8. The magnetic type quick disassembly buckle according to claim 7, wherein both ends of the button (8) are provided with an upper baffle disc (20) and a lower baffle disc (21) respectively, an upper sink slot (22) and a lower sink slot (23) are formed in both ends of the through hole (24) respectively, during clamping, the button (8) moves upward so that the lower baffle disc (21) abuts against inside of the lower sink disc (23), and during buckle release, the upper baffle disc (20) moves downward so that the upper baffle disc (20) abuts against inside of the upper sink slot (22).

9. The magnetic type quick disassembly buckle according to claim 1, wherein the buckle seat (1) and the quick assembly plate (2) are both rigid plastic structural members.

* * * * *